US008231826B2

(12) United States Patent
Ueoka et al.

(10) Patent No.: US 8,231,826 B2
(45) Date of Patent: Jul. 31, 2012

(54) HOT-STRIP COOLING DEVICE AND COOLING METHOD

(75) Inventors: Satoshi Ueoka, Fukuyama (JP); Akio Fujibayashi, Kawasaki (JP); Naoki Nakata, Fukuyama (JP); Takashi Kuroki, Fukuyama (JP); Shougo Tomita, Fukuyama (JP)

(73) Assignee: JFE Steel Corporation, Tokyo (JP)

( * ) Notice: Subject to any disclaimer, the term of this patent is extended or adjusted under 35 U.S.C. 154(b) by 918 days.

(21) Appl. No.: 12/224,195

(22) PCT Filed: Nov. 9, 2006

(86) PCT No.: PCT/JP2006/322798

§ 371 (c)(1),
(2), (4) Date: Aug. 20, 2008

(87) PCT Pub. No.: WO2007/099676

PCT Pub. Date: Sep. 7, 2007

(65) Prior Publication Data

US 2009/0019907 A1 Jan. 22, 2009

(30) Foreign Application Priority Data

Mar. 3, 2006 (JP) ..... 2006-057119

(51) Int. Cl.

| | |
|---|---|
| ***C21D 9/54*** | (2006.01) |
| *C21D 1/00* | (2006.01) |
| *C21D 9/00* | (2006.01) |
| *C21B 7/10* | (2006.01) |
| *B21B 27/06* | (2006.01) |
| *B21D 31/00* | (2006.01) |

(52) U.S. Cl. ..... 266/113; 72/201; 72/364; 266/46; 266/114

(58) Field of Classification Search ..... 72/201, 72/364; 266/46, 113, 114
See application file for complete search history.

(56) References Cited

U.S. PATENT DOCUMENTS

| | | | | |
|---|---|---|---|---|
| 4,507,949 | A * | 4/1985 | Killilea | 72/201 |
| 5,697,169 | A | 12/1997 | Jacob | |
| 6,733,720 | B2 * | 5/2004 | Fujibayashi et al. | 266/46 |
| 2009/0108508 | A1 | 4/2009 | Ueoka et al. | |

FOREIGN PATENT DOCUMENTS

| | | | |
|---|---|---|---|
| JP | 61-012829 | A | 1/1986 |
| JP | 09-141322 | A | 6/1997 |
| JP | 10-166023 | A | 6/1998 |
| JP | 10-249429 | A | 9/1998 |
| JP | 11-138207 | A | 5/1999 |
| JP | 2001-1286925 | A | 10/2001 |
| JP | 2002-239623 | A | 8/2002 |
| JP | 2003-191005 | A | 7/2003 |
| JP | 2004-330237 | A | 11/2004 |
| JP | 2005-059038 | A | 3/2005 |
| JP | 2006-035233 | A | 2/2006 |
| WO | WO 91/04109 | A1 | 4/1991 |

* cited by examiner

*Primary Examiner* — Jessica L Ward
*Assistant Examiner* — Alexander Polyansky
(74) *Attorney, Agent, or Firm* — Holtz, Holtz, Goodman & Chick, P.C.

(57) ABSTRACT

A hot-strip cooling device and a cooling method are provided wherein uniform cooling of a hot-rolled steel strip using coolant is possible from the leading end to the trailing end of the steel strip. A cooling device (10) includes a plurality of round nozzles (15) disposed obliquely in such a manner as to eject rod-like flows of coolant at an ejection angle θ toward the upstream side in a direction in which a steel strip (12) travels, and a pinch roll (11) disposed on the upstream side with respect to the round nozzles (15) and configured to pinch the steel strip (12) in combination with a roller table (8).

9 Claims, 3 Drawing Sheets

HOT-STRIP COOLING DEVICE AND COOLING METHOD

This application is the United States national phase application of International Application PCT/JP2006/322798 filed Nov. 9, 2006.

TECHNICAL FIELD

The present invention relates to cooling devices and cooling methods for cooling hot-rolled steel strips.

BACKGROUND ART

In general, hot strips are manufactured in the following manner: A slab is heated to a predetermined temperature in a heating furnace. The heated slab is rolled by using a roughing stand, whereby a rough bar having a predetermined thickness is obtained. The rough bar is rolled by using a continuous finishing stand constituted by a plurality of rolling stands, whereby a steel strip having a predetermined thickness is obtained. The steel strip is cooled by using a cooling device provided above a run-out table and subsequently is coiled by using a down coiler.

In this process, in the cooling device provided above the run-out table for continuously cooling the hot steel strip that has been subjected to hot rolling, a plurality of linear laminar flows of coolant are ejected from round-type laminar-flow nozzles onto roller-tables for conveying the steel strip over the width of the roller-tables, so as to perform upper-side cooling. On the other hand, lower-side cooling is generally performed by ejecting coolant from spray nozzles disposed between the roller-tables.

However, such a conventional cooling device, in which the round-type laminar nozzles used for upper-side cooling eject coolant in a free-fall-flow form, has problems including the following. Residual coolant on the steel strip may prevent coolant from reaching the steel strip, and thus producing variations in coolability in the cases of having and not having residual coolant on the steel strip. Moreover, coolant that has fallen onto the steel strip spreads in arbitrary directions, thereby producing variations in the cooling zone, leading to thermal instability in cooling. As a result of such variations in coolability, the quality of the steel strip tends to become nonuniform.

To obtain stable coolability by purging coolant on the steel strip (residual coolant), some methods have been proposed including the following: a method in which residual coolant is removed by obliquely ejecting fluid in a direction crossing the upper surface of the steel strip (see Patent Document 1, for example); and a method in which uniformity in the cooling zone is obtained by blocking residual coolant using constraining rolls, serving as purging rolls, for constraining the vertical movement of the steel strip (see Patent Document 2, for example).

Cited Patent Documents are listed below, including Patent Document 3, which will be cited in Best Modes for Carrying Out the Invention.

Patent Document 1: Japanese Unexamined Patent Application Publication No. 9-141322

Patent Document 2: Japanese Unexamined Patent Application Publication No. 10-166023

Patent Document 3: Japanese Unexamined Patent Application Publication No. 2002-239623

DISCLOSURE OF THE INVENTION

In the method disclosed in Patent Document 1, however, the amount of residual coolant on the steel strip becomes larger in more downstream regions. This reduces the purging effect in more downstream regions. On the other hand, in the method disclosed in Patent Document 2, the leading end of the steel strip that has come out of a rolling stand is conveyed without the constraint of the constraining rolls before reaching a down coiler. This means that the purging effect that would be produced by the constraining rolls (purging rolls) cannot be obtained. Moreover, the steel strip passes over a run-out table while the leading end of the steel strip moves vertically in a wavelike motion. If coolant is supplied onto the leading end of the steel strip in such a state, the coolant tends to reside selectively in valleys of the wavy part. This causes a cooling-temperature hunting phenomenon before the down coiler catches the leading end of the steel strip and a tension is applied to the steel strip in such a manner that the steel strip is stretched and thus the waviness is eliminated. Such a cooling-temperature hunting phenomenon also causes variations in the mechanical characteristic of the steel strip.

The present invention has been developed in view of the circumstances described above, and aims to provide a hot-strip cooling device and a cooling method in which a steel strip can be cooled uniformly from the leading end to the trailing end thereof by realizing high coolability and a stable cooling zone during cooling of the hot-rolled steel strip using coolant.

To solve the problems described above, the present invention includes the following features.

[1] A hot-strip cooling device for cooling a hot strip that has been subjected to finish rolling while being conveyed over a run-out table, the device comprising:

a plurality of cooling nozzles that are disposed above a steel strip and eject rod-like flows of coolant at an ejection angle tilted toward the upstream side in a steel-strip traveling direction; and purging means that is disposed on the upstream side with respect to the cooling nozzles and purges the coolant that has been ejected from the cooling nozzles and resides on the steel strip.

[2] The hot-strip cooling device according to [1], wherein the cooling nozzles are arranged in such a manner that a row of the cooling nozzles are provided in a steel-strip width direction and that a plurality of the rows are provided in the steel-strip traveling direction, and wherein widthwise positions of the cooling nozzles provided in the individual rows are set in such a manner that the widthwise positions in an upstream row and the widthwise positions in an adjacent downstream row are staggered.

[3] The hot-strip cooling device according to [1] or [2], wherein an angle between the steel strip and the rod-like flows ejected from the cooling nozzles is 55° or smaller.

[4] The hot-strip cooling device according to [2] or [3], wherein on-off control of the coolant is possible independently for each unit including one or more rows of the cooling nozzles.

[5] The hot-strip cooling device according to any of [1] to [4], wherein the purging means is a pinch roll that is rotatably driven and is movable up and down in such a manner as to rotatably touch the steel strip.

[6] The hot-strip cooling device according to any of [1] to [4], wherein the purging means includes one or more rows of slit- or round-type nozzles that eject purging fluid at an ejection angle tilted toward the downstream side in the steel-strip traveling direction.

[7] A method for cooling a hot strip that has been subjected to finish rolling while being conveyed over a run-out table, the method comprising:

ejecting rod-like flows of coolant toward the upper surface of a steel strip at an angle tilted toward the upstream side in a steel-strip traveling direction; and purging the coolant by using purging means disposed on the upstream side with respect to a position where the rod-like flows are ejected.

[8] The method for cooling a hot strip according to [7], wherein coolability is controlled by changing the length of a cooling zone, the length of the cooling zone being changed by controlling the number of rows of nozzles, in the steel-strip traveling direction, to be used for ejection of the rod-like flows.

[9] The method for cooling a hot strip according to [7] or [8], wherein a gap setting for a pinch roll, which is used as the purging means, is determined beforehand to be a value smaller than or equal to the thickness of the steel strip, and ejection of the coolant is started after the leading end of the steel strip is pinched, and wherein, almost at the same time when the leading end of the steel strip is caught by a coiler, the pinch roll is moved up slightly while being rotated.

[10] The method for cooling a hot strip according to [8], wherein slit- or round-type nozzles that eject purging fluid at an angle tilted toward the downstream side in the steel-strip traveling direction are used as the purging means, and at least one of the fluid amount, fluid pressure, and number of rows of the nozzles to be used for ejection of the purging fluid is changed in accordance with the number of rows of the nozzles to be used for ejection of the rod-like flows at an angle tilted toward the upstream side in the steel-strip traveling direction.

[11] The method for cooling a hot strip according to any of [8] to [10], wherein the number of the rows, in the steel-strip traveling direction, of the nozzles to be used for ejection of the rod-like flows at an angle tilted toward the upstream side in the steel-strip traveling direction is controlled by changing the length of the cooling zone, the length of the cooling zone being changed by giving higher ejection priority to the rows of the nozzles nearer to the purging means and sequentially turning the rows of the nozzles on the downstream side on or off.

According to the present invention, cooling can be performed uniformly from the leading end to the trailing end of a steel strip, whereby the quality of the steel strip can be stabilized. Consequently, the margin of the steel strip to be cut off is reduced. Thus the yield becomes high.

Figure 1:
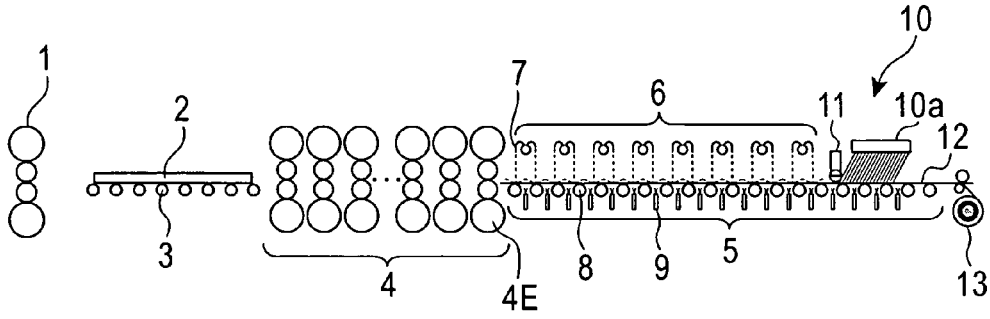
FIG. 1 shows the configuration of a rolling system in first and second embodiments of the present invention.

Reference numerals in the drawings denote as follows:

1 roughing stand
2 rough bar
3 table roller
4 group of continuous finishing stand
4E final finishing stand
5 run-out table
6 cooling device
7 round-type laminar nozzle
8 table roller
9 spray nozzle
10 cooling device
10*a* cooling-device body
10*b* cooling-device body
11 pinch roll
12 steel strip
13 down coiler
14 coolant nozzle header
15 round nozzle
16 coolant supply pipe
17 proximity cooling device
18 pinch roll
19 rod-like-flow ejection nozzle serving as purging means

BEST MODES FOR CARRYING OUT THE INVENTION

Embodiments of the present invention will now be described with reference to the drawings.

FIG. 1 shows a system for manufacturing hot strips in a first embodiment of the present invention.

A rough bar 2 that has been rolled by a roughing stand 1 is conveyed over table rollers 3, and is continuously rolled by a group of seven continuous finishing stands 4 so as to be made into a steel strip 12 having a predetermined thickness. Subsequently, the steel strip 12 is guided to a run-out table 5, which forms a steel-strip conveying path on the downstream side with respect to a final finishing stand 4E. The run-out table 5 has a total length of about 100 m, and is provided with cooling devices at a part or most part thereof. The steel strip 12 is cooled by the cooling devices and then coiled by a down coiler 13 disposed at the downstream end. Thus, a hot-rolled coil is obtained.

In the first embodiment, a conventional cooling device 6 and a cooling device 10 according to the present invention are disposed in that order as cooling devices for upper-side cooling provided above the run-out table 5. The conventional cooling device 6 includes a plurality of round-type laminar nozzles 7, which are arranged at a predetermined pitch above the run-out table 5 and supply coolant in a free-fall-flow form onto the steel strip. As cooling devices for lower-side cooling, a plurality of spray nozzles 9 are disposed between table rollers 8 for conveying the steel strip.

Figure 2:
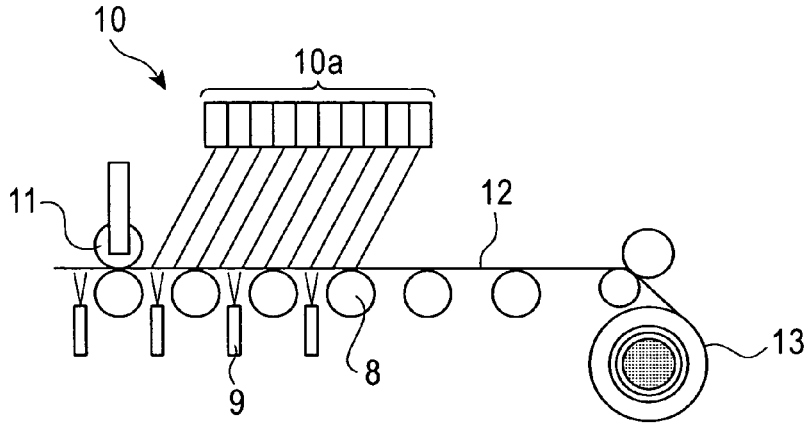
FIG. 2 shows the configuration of a cooling device in the first embodiment of the present invention.

The configuration of a part including the cooling device 10 according to the first embodiment of the present invention is shown in FIG. 2. A cooling-device body 10*a*, which will be described below, is disposed above the run-out table 5, and a pinch roll 11 serving as purging means is disposed on the upstream side with respect to the cooling-device body 10*a*. The configuration below the steel strip is similar to that of the conventional cooling device 6. For example, the table rollers 8 for conveying the steel strip that are rotatable and each have a diameter of 350 mm are disposed below the steel strip 12 and are arranged at about a 400-mm pitch in the steel-strip traveling direction.

Figure 3:
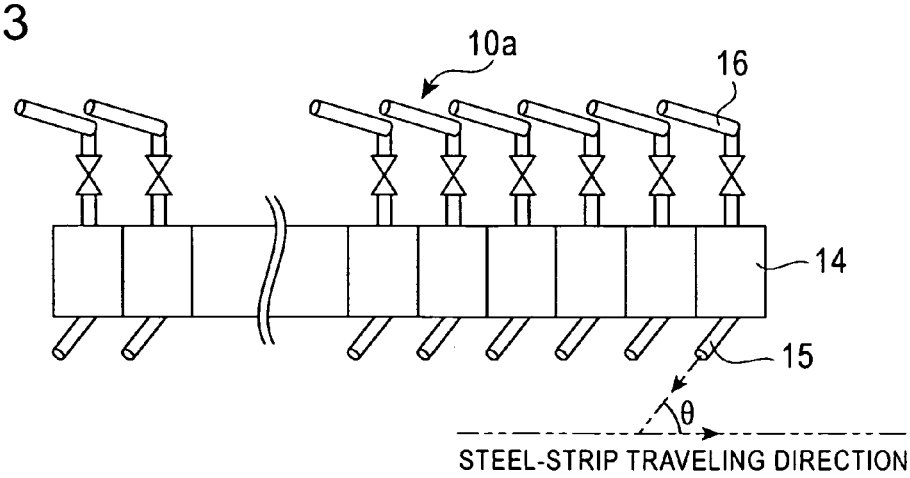
FIG. 3 shows details of the cooling device in the first embodiment of the present invention.

The configuration of the cooling-device body 10*a* is shown in FIG. 3. Specifically, coolant nozzle headers 14 are provided with round nozzles 15 arranged in a predetermined number of rows (100 rows, for example), the rows being arranged at a predetermined pitch (a 100-mm pitch, for example) in the steel-strip conveying direction, the round nozzles 15 in a single row being arranged at a predetermined pitch (a 30-mm pitch, for example) in the steel-strip width direction. Each row of the round nozzles 15 is connected to a coolant supply pipe 16 through the corresponding one of the coolant nozzle headers 14. The on-off control of the individual coolant supply pipes 16 can be performed independently.

The round nozzles 15 are straight-pipe nozzles each having a predetermined bore (10 mmϕ, for example) and a smooth inner surface. The round nozzles 15 provide coolant in a rod-like-flow form. The round nozzles 15 are angled in such a manner as to eject rod-like flows at a predetermined ejection angle θ (θ=50°, for example) toward the upstream side in a direction in which the steel strip 12 travels. Additionally, the delivery ports of the round nozzles 15 are spaced apart from the upper surface of the steel strip 12 at a predetermined height (1000 mm, for example) so that the round nozzles 15 do not touch the steel strip 12 even when the steel strip 12 is caused to move up and down.

The rod-like flow in the present invention is a flow of coolant ejected through a nozzle ejection port having a round shape (including an ellipse or a polygon) in a state subjected to a certain level of pressure. The ejection speed of the coolant ejected through the nozzle ejection port is 7 m/s or higher. The flow of the coolant has a continuous and linear-traveling characteristic, and maintains a substantially round cross section from when ejected through the nozzle ejection port until impacting on the steel strip. That is, the rod-like flow is different from both the free-fall flow from a round-type laminar nozzle and a flow sprayed in a droplet form.

The pinch roll 11, serving as purging means, is disposed over one of the table rolls 8 provided on the upstream side with respect to the cooling-device body 10*a*. The pinch roll 11 is a roll of a predetermined size (with a diameter of 250 mm, for example). The steel strip 12 is pinched between the pinch roll 11 and the table roll, which is provided opposite the pinch roll 11. The pinch roll 11 rotates when driven, and can be moved up and down in such a manner as to rotatably touch the steel strip 12. The manner of maintaining the height of the pinch roll 11 can be changed arbitrarily. The clearance (gap) between the pinch roll 11 and the table roller 8 is preset to a value smaller than the thickness of the steel strip 12 (the steel-strip thickness minus 1 mm, for example). Ejection of coolant from the round nozzles 15 starts when the leading end of the steel strip 12 that has come out of the finishing stand and has passed the pinch roll 11 reaches the outgoing side of the cooling-device body 10*a*. A driving motor (not shown) for driving the pinch roll 11 to rotate is connected to a side of the pinch roll 11. The rotational speed of the pinch roll 11 is adjusted by the driving motor in such a manner that the peripheral speed of the pinch roll 11 matches the speed of conveyance of the steel strip 12. The cooling-device body 10*a* and the pinch roll 11 are arranged in such a manner that coolant ejected from the round nozzles in the front row (the most upstream row) lands on the steel strip 12 at a downstream side with respect to a point where the pinch roll 11 rotatably touches the steel strip 12.

As described above, in the first embodiment, the cooling device 10 includes a plurality of the round nozzles 15 angled in such a manner as to eject rod-like flows at the ejection angle θ toward the upstream side in a direction in which the steel strip 12 travels, and the pinch roll 11 disposed on the upstream side with respect to the round nozzles 15 so as to pinch the steel strip 12 in combination with the roller table 8. Therefore, the coolant that has been supplied onto the steel strip 12 through the round nozzles 15 (the residual coolant) flows toward the upstream side in the direction in which the steel strip 12 travels, and the flowed residual coolant is blocked by the pinch roll 11. This makes the cooling zone to be cooled by the coolant become uniform. Further, since rod-like flows are ejected from the round nozzles 15, fresh coolant can be caused to break through the residual coolant on the steel strip 12 and to reach the steel strip 12.

Conventionally, the leading end of the steel strip becomes wavy, and coolant resides selectively in valleys of the wavy part, whereby undercooling occurs. However, the purging means prevents the residual coolant from flowing outside (toward the upstream side of) the water-cooling device.

This solves the problems, occurring in conventional cooling devices using free-fall flows from round-type laminar nozzles, such as that coolability varies in the cases of having and not having residual coolant on the steel strip, and that coolant that has fallen onto the steel strip spreads in arbitrary directions and thus produces variations in the cooling zone, leading to thermal instability in cooling. Accordingly, high and stable coolability can be obtained regardless of the shape of the steel strip. For example, quick cooling of a 3-mm-thick steel strip at a cooling rate of over 100° C./s can be realized.

In the above case, the angle θ between the steel strip 12 and the rod-like flows ejected from the round nozzles 15 is preferably set to 55° or smaller. If the angle θ exceeds 60° while the steel strip is at rest, the velocity component of the coolant that has landed on the steel strip 12 (residual coolant) in the steel-strip traveling direction becomes small. In such a case, the residual coolant interferes with residual coolant from an adjacent row on the upstream side, whereby the residual coolant is prevented from flowing. Consequently, part of the residual coolant may flow downstream over the landing points (the points of impact) of the rod-like flows from the round nozzles 15 in the most downstream row. This may cause instability in the cooling zone. Moreover, the faster the steel strip travels, the more easily the residual coolant flows over to the downstream side while the steel strip is traveling. Therefore, to ensure that the coolant that has landed on the steel strip 12 flows upstream in the steel-strip conveying direction, it is preferable that the angle θ be set to 55° or smaller, and is more preferable that the angle θ be adjusted within the range of 30° to 50° in accordance with the steel-strip traveling speed. However, to maintain a predetermined height from the steel strip 12 with the angle θ being smaller than 30°, the distance from the round nozzles 15 to the landing points (the points of impact) of the rod-like flows becomes too long. This may cause the rod-like flows to be scattered, whereby the cooling characteristic may be degraded. Hence, it is preferable that the angle θ between the steel strip 12 and the rod-like flows be 30° or larger.

The present invention employs, as coolant nozzles, the round nozzles 15 that produce rod-like flows for the following reason. To assuredly perform cooling, coolant needs to be assuredly brought to the steel strip and to be made to impact thereon. To realize this, it is necessary to cause fresh coolant to break through residual coolant on the steel strip 12 and to reach the steel strip 12. Therefore, a continuous and linear-traveling flow of coolant having a large penetration capability is necessary, not a flow of coolant having a small penetration capability, such as a group of droplets ejected from a spray nozzle. Since the laminar flow produced by a conventional round-type laminar nozzle is a free-fall flow, it is difficult for such a flow of coolant to reach the steel strip if residual coolant resides on the steel strip. Moreover, there are problems such as that coolability varies in the cases of having and not having residual coolant, and that coolant that has fallen onto the steel strip spreads in arbitrary directions and thus varies the coolability when the traveling speed of the steel strip is changed. Therefore, the present invention employs the round nozzles 15, whose shape may be an ellipse or a polygon, whereby continuous and linear-traveling rod-like flows are ejected from the nozzle ejection ports at an ejection speed of 7 m/s or higher while maintaining substantially round cross sections of the flows from when ejected from the nozzle ejection ports until impacting on the steel strip. With rod-like flows produced when coolant is ejected from the nozzle ejection ports at an ejection speed of 7 m/s or higher, even if the coolant is ejected obliquely, the coolant can stably break through residual coolant on the steel strip. Further, in the present invention, coolant is ejected toward the steel strip obliquely from an upper position in a direction opposite to the steel-strip traveling direction. Accordingly, the relative velocity between the steel strip and the coolant at the impact of the coolant on the steel strip, which is the combination of the velocity of the steel strip and the velocity of the flow traveling in a direction opposite to the steel-strip traveling direction (flow velocity×cos θ), is larger than that in the case of ejection giving perpendicular impact. If coolant is ejected in a rod-like-flow form, the flow of the coolant would not be scattered and therefore can break through residual coolant on the steel strip and reach the steel strip. Thus, stable cooling is realized.

The round nozzles 15 can be replaced with slit-type nozzles. However, if slit-type nozzles each having a gap (which practically needs to be of 3 mm or larger) sufficient for not causing clogging of the nozzle are used, the cross sections of the nozzles become extremely larger than those in the case where the round nozzles 15 are provided at a certain pitch in the width direction. Consequently, to eject coolant from the ejection ports of such nozzles at an ejection speed of 7 m/s or higher so as to obtain a penetration capability sufficient for breaking through the residual coolant, a very large amount of coolant is required. Because this greatly increases the system cost, such a replacement is not practical.

In a method in which coolant is ejected toward a steel strip obliquely from an upper position in a direction opposite to the steel-strip traveling direction, since the relative velocity at the impact is larger than that in the conventional cooling method in which coolant is made to fall perpendicularly onto a steel strip, high cooling efficiency can be obtained. Further, since the relative velocity between the coolant and the steel strip is still larger than that in the case where coolant is ejected at an angle tilted from the back toward the front in the steel-strip traveling direction, excellent cooling efficiency can be obtained.

It is desirable that the thickness of the rod-like flow be several millimeters, or at least 3 mm or larger. With a thickness smaller than 3 mm, it is difficult to cause the coolant to break through residual coolant on the steel strip and to impact thereon.

Figure 7:
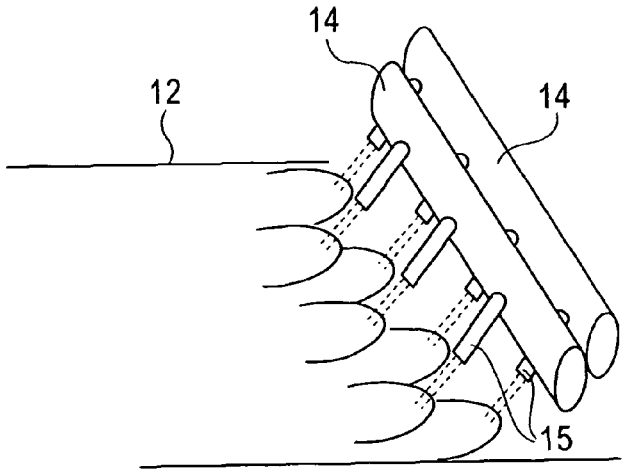
FIG. 7 illustrates the points of impact in the cooling device of the present invention.
Figure 8A:
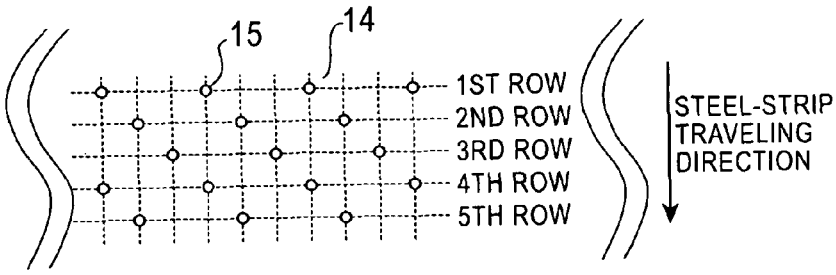
FIGS. 8A and 8B show details of rod-like-flow ejection nozzles of cooling-device bodies in the first and second embodiments of the present invention and of purging means in the second embodiment.
Figure 8B:
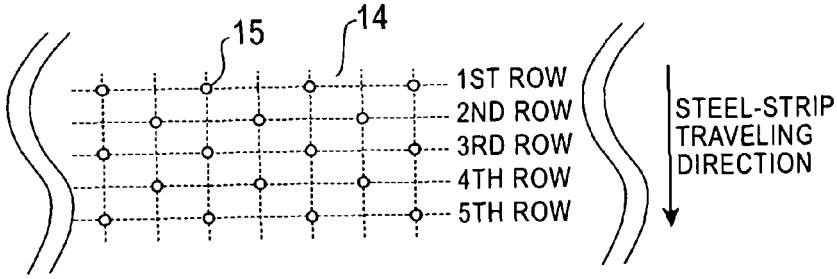

The round nozzles 15 are preferably arranged as shown in FIG. 7, in which the points of impact of rod-like flows in one row (an upstream row) and the points of impact of rod-like flows in a row adjacent thereto (a downstream row) are staggered in the width direction. For example, as shown in FIG. 8A, the nozzle arrangement pitch in the width direction is the same for both the upstream row and the adjacent downstream row, but the positions in the width direction are shifted by ⅓ of the nozzle arrangement pitch in the width direction. Alternatively, as shown in FIG. 8B, nozzles in the adjacent downstream row may be disposed at the centers of adjacent nozzles in the upstream row. With such an arrangement, the rod-like flows in the adjacent downstream row impact on respective points between the rod-like flows adjacent to each other in the width direction, where coolability is reduced. Thus, the reduced coolability is offset, whereby uniform cooling in the width direction is realized.

As described above, in the cooling device 10, the clearance between the pinch roll 11 and the roller table 8 is preset to a value smaller than the thickness of the steel strip 12 (the steel-strip thickness minus 1 mm, for example), and ejection of coolant from the round nozzles 15 starts when the leading end of the steel strip 12 that has come out of the finishing stand and has passed the pinch roll 11 reaches the outgoing side of the cooling-device body 10*a*. In the case of a thick steel strip (having a thickness of 2 mm or larger, for example), coolant may be ejected first and the leading end of the steel strip may be caused to pass thereunder. In such a manner, the steel strip 12 can be subjected to predetermined cooling from the leading end thereof. In the case of a thin steel strip 12 where the passage of the steel strip 12 is unstable under the influence of coolant, coolant may be ejected first at an ejection pressure not having an influence on the passage of the leading end of the steel strip 12, and the ejection pressure may be changed to a predetermined value after the leading end of the steel strip is caught by the pinch roll 11. In this case, the wavelike motion of the steel strip 12 that has occurred between the finishing stand 4 and the pinch roll 11 is suppressed by the pinch roll 11. Therefore, the passage of the leading end of the steel strip below the cooling-device body 10*a* is relatively stabilized compared to that in the case of not having the pinch roll 11, and it is less problematic to start ejection of coolant before the leading end of the steel strip 12 reaches the outgoing side of the cooling-device body 10*a*. This means that it is preferable to adjust the timing of starting ejection of coolant, without influence on the passage of the steel strip, in accordance with the steel-strip thickness, conveying speed, steel-strip temperature, and the like. When the leading end of the steel strip 12 is caught by the down coiler 13 and thus a tension is applied thereto, the pinch roll 11 is moved up slightly (by the steel-strip thickness plus 1 mm, for example) while being rotated, so that the gap becomes larger than the thickness of the steel strip 12. Even in this state, the coolant on the steel strip 12 negligibly flows under the pinch roll 11 toward the upstream side, and good purging can be realized with the pinch roll 11. The reason why the pinch roll 11 is moved up slightly is for preventing the occurrence of scratches and slacking in the steel strip because of subtle nonconformity between the rotational speed of the pinch roll and the traveling speed of the steel strip.

In accordance with the traveling speed and temperature of the steel strip 12, for example, the coolant ejection is controlled as follows. In accordance with the traveling speed of the steel strip 12, the measured temperature of the steel strip 12, and the temperature difference from the target cooling-stop temperature, the length of the cooling zone, i.e., the number of rows of the round nozzles 15 to be used for ejection of rod-like flows, is determined first. Then, the round nozzles 15 in the determined number of rows nearer to the pinch roll 11 are set to be used for ejection with higher priority. After that, the number of rows of the round nozzles 15 used for ejection is changed considering the post-cooling temperature measurement results of the steel strip 12 in conjunction with changes in the traveling speed (acceleration or deceleration) of the steel strip 12. Change of the cooling-zone length is desirably performed by changing the number of rows to be used for ejection in such a manner as to sequentially turn the nozzle rows on the downstream side on or off while the nozzle rows near to the pinch roll 11 are kept performing ejection.

The main role of the pinch roll 11 is to produce a uniform cooling zone that is cooled with coolant, by blocking the coolant supplied from the cooling-device body 10*a*. Therefore, as described below in a second embodiment of the present invention, the purging means is not limited to the pinch roll 11 described above, and may be any of other various components capable of purging coolant that has been ejected from the round nozzles 15 onto a steel strip.

Now, a second embodiment of the present invention will be described in which the pinch roll 11 in the first embodiment is substituted by nozzles, particularly rod-like-flow ejection nozzles, that serve as purging means and eject purging fluid. A rod-like flow serving as purging means, which is not intended for performing cooling, is coolant ejected in a pressurized state, the same as the rod-like flow from the round nozzle 15 of the first embodiment. This flow of coolant has a continuous and linear-traveling characteristic and maintains a substantially round cross section from when ejected from a nozzle ejection port until impacting on the steel strip. Therefore, such a flow of coolant is herein referred to as a rod-like flow.

Figure 4:
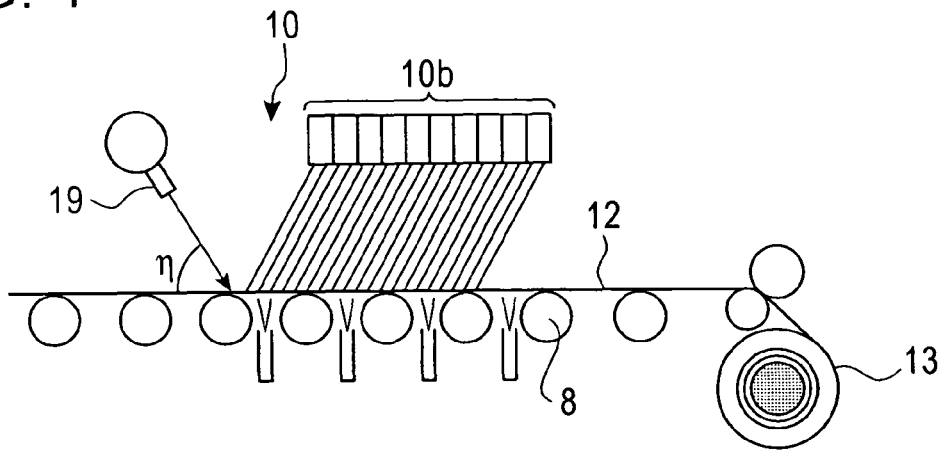
FIG. 4 shows the configuration of a cooling device in the second embodiment of the present invention.

The configuration of a system for manufacturing hot strips in the second embodiment is almost the same as that of the first embodiment shown in FIG. 1. The configuration of a part including the cooling device 10 in the second embodiment is as shown in FIG. 4. Specifically, a cooling-device body 10*b*, which will be described below, is disposed above the run-out table 5, and rod-like-flow ejection nozzles 19 serving as purging means are disposed on the downstream side with respect to the cooling-device body 10*b*. The configuration below the steel strip is the same as that of the first embodiment.

Figure 6:
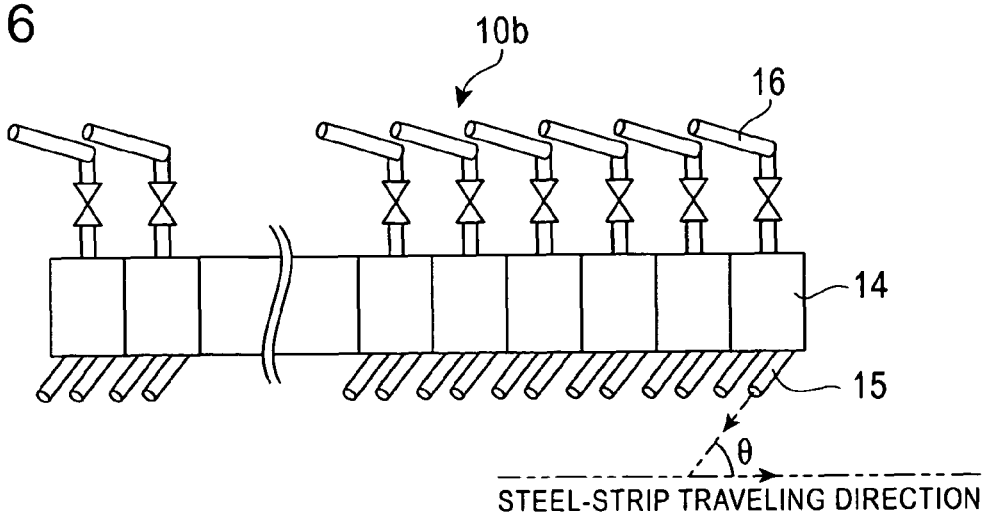
FIG. 6 shows the configuration of the cooling device in the second embodiment of the present invention.

The configuration of the cooling-device body 10*b* is shown in FIG. 6. Similar to the configuration of the cooling-device body 10*a* in the first embodiment, the coolant nozzle headers 14 are provided with the round nozzles 15 arranged in a predetermined number of rows (100 rows, for example), the rows being arranged at a predetermined pitch (a 100-mm pitch, for example) in the steel-strip traveling direction, the round nozzles 15 in a single row being arranged at a predetermined pitch (a 60-mm pitch, for example) in the steel-strip width direction. The round nozzles 15 are disposed at an angle in such a manner as to eject rod-like flows at a predetermined ejection angle θ (θ=50°, for example) in a direction in which the steel strip 12 travels. In the cooling-device body 10*a* of the first embodiment, each row of the round nozzles is connected to one of the coolant supply pipes 16 through the corresponding one of the coolant nozzle headers 14, and the on-off control of the individual coolant supply pipes 16 can be performed independently. In the cooling-device body 10*b* of the second embodiment, each two rows of the round nozzles are connected to one of the coolant supply pipes 16 through the corresponding one of the coolant nozzle headers 14, and for these two rows of the round nozzles as a unit, the on-off control of the individual coolant supply pipes 16 can be performed independently. The bore, ejection angle, nozzle height, and the like of the round nozzles 15 are determined in the same manner as in the first embodiment.

In the cooling-device body 10*b* having such a configuration, the on-off control of the round nozzles is performed for each two rows of the round nozzles as a unit. Such an on-off control is intended for adjusting the temperature at the completion of cooling. The number of units (nozzle rows) in which on-off control is performed is determined by the degree to which temperature can be reduced by turning a single row of the round nozzles on and the setting of temperature accuracy range at the completion of cooling. In the aforementioned configuration, the temperature can be reduced by about 1 to 3° C. per row of the round nozzles. For example, in the case of targeting a temperature accuracy range of ±5° C., if the on-off control can be performed with a resolution of about 5 to 10° C., the temperature can be adjusted to fall within the allowable range. In the second embodiment, assuming that the temperature can be adjusted by 5° C. in a single on-off control, if the on-off control of a single coolant supply pipe 16 can realize the on-off control of two rows of the round nozzles, sufficiently accurate temperature adjustment can be performed. Further, under such an on-off control of a plurality of round nozzle rows as a unit, both the number of shut-off valves, which are necessary components for performing on-off control, and the number of pipes can be reduced, whereby the system can be manufactured at a low cost.

While the second embodiment concerns a mechanism capable of on-off control of each unit including two round nozzle rows, more rows may be included per unit if the required temperature accuracy can be maintained. Further, the number of round nozzle rows per unit to be controlled by a single on-off mechanism may vary with location in the longitudinal direction (the steel-strip traveling direction).

The rod-like-flow ejection nozzles 19 serving as purging means have a predetermined nozzle bore (5 mm, for example) and are arranged on the upstream side with respect to the cooling-device body 10*b* at a predetermined nozzle pitch (40 mm, for example). The rod-like-flow ejection nozzles 19 eject rod-like flows angled toward the cooling-device body 10*b* (the downstream side). The angle η between the steel strip 12 and the rod-like flows ejected from the rod-like-flow ejection nozzles 19, which can be determined in a manner similar to that for the above-described ejection angle θ of the rod-like flows from the cooling-device body 10*a* (10*b*), is preferably 60° or smaller. If the ejection angle η exceeds 60°, the velocity component of the coolant that has landed on the steel strip 12 (residual coolant) in the steel-strip traveling direction becomes small. In such a case, the residual coolant interferes with rod-like flows ejected from the cooling-device body 10*b* on the downstream side, whereby the residual coolant is prevented from flowing. Consequently, part of the residual coolant flows upstream over the rod-like flows from the rod-like-flow ejection nozzles 19. This may cause instability in the cooling zone. Additionally, while the rod-like-flow ejection nozzles 19 perform ejection toward the downstream side in the steel-strip traveling direction, residual coolant originally tends to flow easily in the steel-strip traveling direction because of the shearing force occurring between the steel strip and the residual coolant. Since residual coolant originally has a tendency not to easily flow upstream on the steel strip, the ejection angle η may be at most 5° larger than the ejection angle θ produced by the rod-like flows ejected from the cooling-device body 10*b*, which is disposed on the downstream side in the traveling direction.

Figure 5:
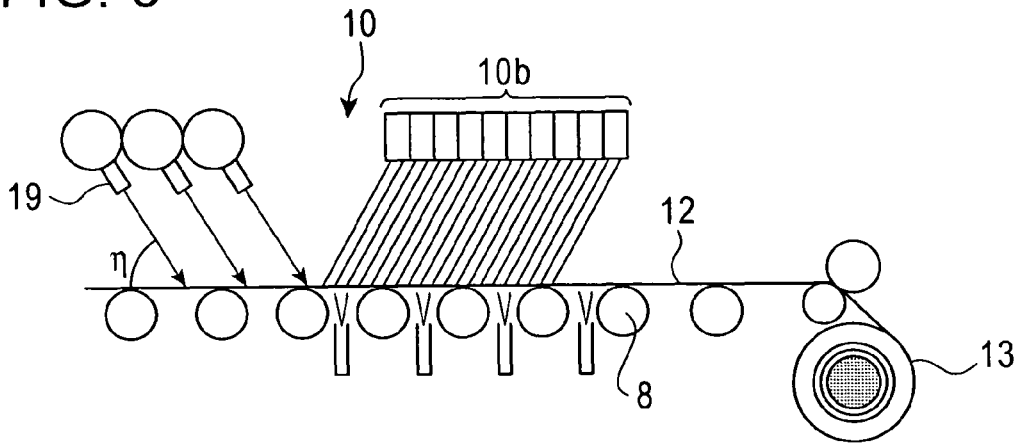
FIG. 5 shows details of the cooling device in the second embodiment of the present invention.

Further, rod-like flows ejected from the rod-like-flow ejection nozzles 19 are required to have a force sufficient that, when the rod-like flows ejected from the rod-like-flow ejection nozzles 19 collide with rod-like flows ejected from the cooling-device body 10*b*, the rod-like flows ejected from the cooling-device body 10*b* are prevented from flowing upstream. Therefore, in the case where the number of rows of the round nozzles 15 to be used in the cooling-device body 10*b* is large, it is preferable to stabilize the purgeability by increasing the amount, speed, and pressure of the flows from the rod-like-flow ejection nozzles 19. Alternatively, as shown in FIG. 5, a plurality of rows (five rows, for example) of the rod-like-flow ejection nozzles 19 serving as purging means may be provided in the steel-strip traveling direction. The number of rows of the rod-like-flow ejection nozzles 19 to be used may be changed in accordance with the number of rows of the round nozzles 15 to be used in the cooling-device body 10*b*.

However, there are gaps in the width direction between rod-like flows ejected from a plurality of the rod-like-flow ejection nozzles 19 that are arranged in the width direction, and residual coolant may flow out through these gaps. Therefore, in the case where the rod-like-flow ejection nozzles 19 are used, it is preferable that the rod-like-flow ejection nozzles 19 be provided in a plurality of rows in the steel-strip traveling direction as shown in FIG. 5, and that, the same as the arrangement of the round nozzles 15 of the cooling-device body 10*a* (10*b*) shown in FIGS. 7, 8A, and 8B, the points of impact of rod-like flows in an upstream row and the points of impact of rod-like flows in an adjacent downstream row be staggered in the width direction. With such an arrangement, the rod-like flows in the adjacent downstream row impact on respective points between the rod-like flows adjacent to each other in the width direction, where purgeability is reduced. Thus, the reduced purgeability cooling is offset.

The cooling-device body 10*b* and the rod-like-flow ejection nozzles 19 are arranged in such a manner that rod-like flows ejected from the cooling-device body 10*b* through the round nozzles in the front row (the most upstream row) land on the steel strip 12 at a downstream side (by 100 mm, for example) with respect to a point where rod-like flows ejected from the rod-like-flow ejection nozzles 19 in the rearmost row (the most downstream row) land on the steel strip 12.

Thus, also in the second embodiment, as in the first embodiment, the problems occurring in the conventional cooling device using free-fall flows from round-type laminar nozzles can be solved, such as that coolability varies in the cases of having and not having residual coolant on the steel strip, and that coolant that has fallen onto the steel strip spreads in arbitrary directions and thus produces variations in the cooling zone, leading to thermal instability in cooling. Accordingly, high and stable coolability can be obtained. For example, quick cooling of a 3-mm-thick steel strip at a cooling rate of over 100° C./s can be realized.

In the case of a thin steel strip 12 where the passage of the steel strip 12 is unstable under the influence of coolant, coolant may be ejected first at an ejection pressure not having an influence on the passage of the leading end of the steel strip 12, and the ejection pressure may be changed to a predetermined value after the leading end of the steel strip is caught by the coiler. In the case of a thick steel strip (having a thickness of 2 mm or larger, for example), coolant may be ejected first and the leading end of the steel strip may be caused to pass thereunder. In such a manner, the steel strip 12 can be subjected to predetermined cooling from the leading end thereof.

The second embodiment concerns an example in which nozzles that eject rod-like flows are used as nozzles serving as purging means that eject purging fluid. The purging means are preferably nozzles that eject rod-like flows having a large momentum, from the viewpoint of blocking rod-like flows from the cooling-device body 10*b*. However, it is not necessary that the nozzles eject rod-like flows. Nozzles that eject flat slit-type flows may be used instead. Further, the ejection speed of the coolant from the nozzle ejection ports may be less than 7 m/s. Moreover, the coolant does not necessarily have to be continuous, and may be in a form including some droplets. This is because, as described in the first embodiment, in the case of use as purging means, a momentum sufficient for pushing back the coolant ejected from the cooling-device body 10*b* is only necessary, and there is no need to cause fresh coolant to break through the residual coolant and to reach the steel strip 12.

The first and second embodiments each concern an example in which the conventional cooling device 6 and the cooling device 10 according to the present invention are disposed in that order above the run-out table 5, as shown in FIG. 1. According to the first and second embodiments, after a steel strip is cooled to some extent by using the conventional cooling device 6, more uniform and stable cooling of the steel strip can be performed by using the cooling device 10 of the present invention. Therefore, the cooling-stop temperature can be particularly made uniform over the entire length of the steel strip. Further, in the case of modifying an existing hot-rolling line, it is only necessary to add the cooling device 10 of the present invention on the downstream side with respect to the conventional cooling device 6. This is advantageous in terms of cost. The present invention is not limited to such embodiments. For example, the conventional cooling device 6 and the cooling device 10 of the present invention may be disposed in the reverse order, or only the cooling device 10 of the present invention may be included.

Figure 9:
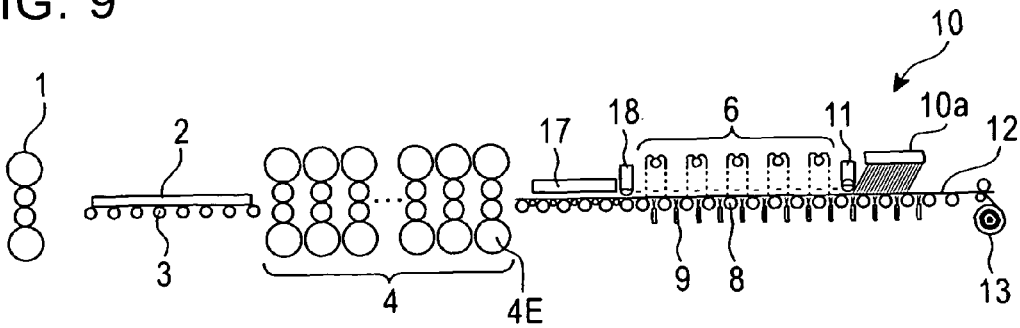
FIG. 9 shows the configuration of a rolling system in a third embodiment of the present invention.

The present invention may also be of another embodiment (a third embodiment), which is shown in FIG. 9. The third embodiment has a configuration in which a cooling device 17, such as the one disclosed in Patent Document 3, and a pinch roll 18 are added to the configuration in the first and second embodiments, between the final finishing stand 4E and the cooling device 6. The cooling device 17 is capable of intense cooling in which the cooling device 17 is positioned in proximity to the steel strip. Such a system is suitable for production of dual-phase steel, which requires cooling performed in two steps: immediately after finish rolling and immediately before coiling. According to need, the conventional cooling device 6, disposed between the two other cooling devices, may be used for performing cooling by ejection. In some cases, the conventional cooling device 6 is not necessary.

Also in the third embodiment, as in the first and second embodiments, the two-step cooling can be performed uniformly from the leading end to the trailing end of the steel strip 12, whereby the quality of the steel strip 12 can be stabilized. Consequently, the margin of the steel strip to be cut off is reduced. Thus the yield becomes high.

EXAMPLE 1

Present Example 1

The present invention was implemented on the basis of the first embodiment, which is denoted as Present Example 1. Specifically, a system configured as shown in FIG. 1 was used. In the cooling-device body 10*a*, on-off control of rod-like flows was possible for each unit including one row of the round nozzles, as shown in FIG. 3. Further, as shown in FIG. 8B, with respect to the widthwise arrangement positions in an upstream row, the widthwise arrangement positions in an adjacent downstream row were shifted by ½ of the widthwise nozzle-arrangement pitch. Further, as shown in FIG. 2, the pinch roll 11 was disposed on the upstream side with respect to the cooling-device body 10*a*.

The finished thickness of the steel strip was set to 2.8 mm. The steel-strip speed at the exit of the finishing stand 4 was 700 mpm at the leading end, and was gradually increased to a maximum speed of 1000 mpm (16.7 m/s) after the leading end of the steel strip reached the down coiler 13. The steel-strip temperature at the exit of the finishing stand 4 was 850° C., which was reduced to about 650° C. by using the conventional cooling device 6, and further to 400° C., which is the target coiling temperature, by using the cooling device 10 according to the present invention. The allowable coiling-temperature deviation was set to ±20° C.

In this case, the ejection angle θ of the round nozzles 15 was set to 50°, and rod-like flows were ejected from the round nozzles 15 at an ejection speed of 30 m/s. The clearance between the pinch roll 11 and the table roller 8 was preset to the steel-strip thickness minus 1 mm, i.e., 1.8 mm.

Ejection of the rod-like flows was started beforehand under predetermined conditions. In this state, the leading end of the steel strip was caused to pass thereunder. When the leading end of the steel strip was caught by the down coiler 13 and thus a tension was applied thereto, the pinch roll 11 was moved up by 2 mm. Even in this state, the coolant on the steel strip negligibly flowed under the pinch roll 11 toward the upstream side, and good purging could be realized with the pinch roll 11. Moreover, neither scratches nor slacking occurred in the steel strip.

In accordance with the traveling speed of the steel strip, the measured temperature of the steel strip, and the temperature difference from the target cooling-stop temperature, the number of rows of the round nozzles 15 to be used for ejection of rod-like flows was determined. Then, the round nozzles 15 in the determined number of rows nearer to the pinch roll 11 were set to be used for ejection with higher priority. After that, the number of rows of the round nozzles 15 to be used for ejection of rod-like flows was increased sequentially toward the downstream side, with the increase in the traveling speed of the steel strip 12.

As a result, in Present Example 1, the steel-strip temperature at the down coiler 13 fell within the range of 400° C.±10° C. Thus, highly uniform cooling of the steel strip from the leading end to the trailing end thereof could be realized within the target temperature deviation.

Present Example 2

The present invention was implemented on the basis of the second embodiment, which is denoted as Present Example 2. Specifically, as described above, a system having a configuration almost the same as the one shown in FIG. 1 was used. In the cooling-device body 10*b*, on-off control of rod-like flows was possible for each unit including two rows of the round nozzles, as shown in FIG. 6. Further, as shown in FIG. 8B, with respect to the widthwise arrangement positions in an upstream row, the widthwise arrangement positions in an adjacent downstream row were shifted by ½ of the widthwise nozzle-arrangement pitch. Further, as shown in FIG. 5, a plurality of rows of the rod-like-flow ejection nozzles 19 that eject purging fluid were disposed on the upstream side with respect to the cooling-device body 10*b*.

The finished thickness of the steel strip was set to 2.8 mm. The steel-strip speed at the exit of the finishing stand 4 was 700 mpm at the leading end, and was gradually increased to a maximum speed of 1000 mpm (16.7 m/s) after the leading end of the steel strip reached the down coiler 13. The steel-strip temperature at the exit of the finishing stand 4 was 850° C., which was reduced to about 650° C. by using the conventional cooling device 6, and further to 400° C., which is the target coiling temperature, by using the cooling device 10 according to the present invention. The allowable coiling-temperature deviation was set to ±20° C.

In this case, the ejection angle θ of the round nozzles 15 included in the cooling-device body 10*b* was set to 50°, and rod-like flows were ejected from the round nozzles 15 at an ejection speed of 35 m/s.

On the other hand, the ejection angle η of the rod-like-flow ejection nozzles 19, serving as purging means, was set to 50°, which was the same angle as that for the round nozzles 15 included in the cooling-device body 10*b*.

In accordance with the traveling speed of the steel strip, the measured temperature of the steel strip, and the temperature difference from the target cooling-stop temperature, the number of rows of the round nozzles 15 to be used for ejection of rod-like flows in the cooling-device body 10*b* was determined. Then, the round nozzles 15 in the determined number of rows on the front side (rows that are more upstream) were set to be used for ejection with higher priority. After that, the number of rows of the round nozzles 15 to be used for ejection of rod-like flows in the cooling-device body 10*b* was increased sequentially toward the downstream side, with the increase in the traveling speed of the steel strip 12. The rod-like-flow ejection nozzles 19 were set to be used for ejection sequentially starting from those in the end row (the most downstream row), the end row having the highest priority. With the change in the number of rows of the round nozzles 15 to be used in the cooling-device body 10*b*, the amount of coolant to be ejected from the rod-like-flow ejection nozzles 19 was also increased. During this process, when the amount of flow from the rod-like-flow ejection nozzles 19 reached the upper limit of the system, the number of rows of the rod-like-flow ejection nozzles 19 to be used for ejection was increased sequentially toward the upstream side.

In this case, ejection of the rod-like flows was started beforehand under predetermined conditions. In this state, the leading end of the steel strip was caused to pass thereunder. Even in this state, the coolant on the steel strip negligibly flowed upstream through the rod-like flows ejected from the rod-like-flow ejection nozzles 19, and good purging could be realized with the rod-like-flow ejection nozzles 19.

As a result, in Present Example 2, the steel-strip temperature at the down coiler 13 fell within the range of 400° C.±18° C. Thus, highly uniform cooling of the steel strip from the leading end to the trailing end thereof could be realized within the target temperature deviation.

Comparative Example

In contrast, in Comparative Example in which the system shown in FIG. 1 is used, the cooling device 10 of the present invention was not used for performing cooling of a steel strip. In this case, the steel strip was cooled to 400° C., which is the target coiling temperature, by using only the conventional cooling device 6. The allowable coiling-temperature deviation was set to ±20° C. The other conditions were the same as those in Present Example 1 described above.

As a result, in Comparative Example, cooling-temperature hunting occurred in the steel-strip longitudinal direction. The reason for this is presumed to be that residual coolant that had stayed in valleys formed in the steel strip caused temperature variations in the longitudinal direction. This caused wide variation in the steel-strip temperature at the down coiler 13 from 300° C. to 420° C. while the target temperature deviation was ±20° C. Accordingly, the strength within the steel strip also varied significantly.

The invention claimed is:

1. A method for cooling a hot strip that has been subjected to a finish rolling while being conveyed over a run-out table, the method comprising:

(a) ejecting a coolant through a plurality of cooling nozzles at a speed of 7 m/s or higher towards an upper surface of a steel strip at an angle tilted towards an upstream side in a steel-strip traveling direction; and (b) purging the coolant by using a pinch roll disposed on the upstream side with respect to a position where the coolant is ejected, wherein the plurality of cooling nozzles are arranged in a manner such that the plurality of cooling nozzles are provided in a steel-strip width direction and that the plurality of cooling nozzles form a plurality of rows in the steel-strip traveling direction, wherein positions of the plurality of cooling nozzles provided in the plurality of rows in said width direction are set in a manner such that the positions in said width direction in an upstream row and the positions in said width direction in an adjacent downstream row are staggered, wherein an angle between the steel strip and the flow of the coolant elected from the cooling nozzles is 55° or smaller.

2. The method for cooling a hot strip according to claim 1, wherein coolability is controlled by changing the length of a cooling zone, the length of the cooling zone being changed by controlling the number of rows of the cooling nozzles, in the steel-strip traveling direction, used for the electing of the coolant.

3. The method for cooling a hot strip according to claim 1, wherein a gap setting for the pinch roll is determined beforehand to be a value smaller than or equal to the thickness of the steel strip, and the ejecting of the coolant is started after the leading end of the steel strip is pinched, and wherein, at the same time when the leading end of the steel strip is caught by a coiler, the pinch roll is moved up slightly while being rotated.

4. A method for cooling a hot strip that has been subjected to a finish rolling while being conveyed over a run-out table, the method comprising:

(a) ejecting a coolant through a plurality of cooling nozzles at a speed of 7 m/s or higher towards an upper surface of a steel strip at an angle tilted towards an upstream side in a steel-strip traveling direction, (b) ejecting a purging fluid through a plurality of purging nozzles at an angle tilted towards a downstream side in the steel-strip traveling direction, and at least one of a fluid amount of the purging fluid, a fluid pressure of the purging fluid, and a number of rows of the purging nozzles is changed in accordance with the number of rows of the cooling nozzles for the electing of the coolant at the angle tilted towards the upstream side in the steel-strip traveling direction, wherein the plurality of cooling nozzles are arranged in a manner such that the plurality of cooling nozzles are provided in a steel-strip width direction and that the plurality of cooling nozzles form a plurality of rows in the steel-strip traveling direction, wherein positions of the plurality of cooling nozzles provided in the plurality of rows in said width direction are set in a manner such that the positions in said width direction in an upstream row and the positions in said width direction in an adjacent downstream row are staggered, and wherein an angle between the steel strip and the flow of the coolant ejected from the cooling nozzles is 55° or smaller.

5. The method for cooling a hot strip according to claim 2, wherein the number of the rows, in the steel-strip traveling direction, of the cooling nozzles used for the electing of the coolant at an angle tilted towards the upstream side in the steel-strip traveling direction is controlled by changing the length of the cooling zone, the length of the cooling zone being changed by giving a higher ejection priority to the rows of the cooling nozzles nearer to the pinch rolls and sequentially turning the rows of the nozzles on the downstream side on or off.

6. The method for cooling a hot strip according to claim 2, wherein a gap setting for a pinch roll is predetermined to be a value smaller than or equal to the thickness of the steel strip, and the ejecting of the coolant is started after the leading end of the steel strip is pinched, and wherein, at the same time when the leading end of the steel strip is caught by a coiler, the pinch roll is moved up slightly while being rotated.

7. The method for cooling a hot strip according to claim 3, wherein the number of the rows, in the steel-strip traveling direction, of the cooling nozzles used for the electing of the coolant at an angle tilted towards the upstream side in the steel-strip traveling direction is controlled by changing the length of the cooling zone, the length of the cooling zone being changed by giving a higher ejection priority to the rows of the nozzles nearer to the pinch roll and sequentially turning the rows of the nozzles on the downstream side on or off.

8. The method for cooling a hot strip according to claim 6, wherein the number of the rows, in the steel-strip traveling direction, of the cooling nozzles used for the ejecting of the coolant at an angle tilted towards the upstream side in the steel-strip traveling direction is controlled by changing the length of the cooling zone, the length of the cooling zone being changed by giving a higher ejection priority to the rows of the nozzles nearer to the pinch roll and sequentially turning the rows of the nozzles on the downstream side on or off.

9. The method for cooling a hot strip according to claim 1, wherein the cooling nozzles are round.

* * * * *

UNITED STATES PATENT AND TRADEMARK OFFICE

CERTIFICATE OF CORRECTION

PATENT NO. : 8,231,826 B2
APPLICATION NO. : 12/224195
DATED : July 31, 2012
INVENTOR(S) : Satoshi Ueoka et al.

It is certified that error appears in the above-identified patent and that said Letters Patent is hereby corrected as shown below:

Column 15, Line 14 (Claim 1, Line 21) after “staggered,” insert --and--

Column 15, Line 16 (Claim 1, Line 23) delete “elected” and insert --ejected--

Column 15, Line 22 (Claim 2, Line 5) delete “electing” and insert --ejecting--

Column 15, Line 46 (Claim 4, Line 14) delete “electing” and insert --ejecting--

Column 16, Line 14 (Claim 5, Line 3) delete “electing” and insert --ejecting--

Column 16, Line 19 (Claim 5, Line 7) delete “rolls” and insert --roll--

Column 16, Line 32 (Claim 7, Line 3) delete “electing” and insert --ejecting--

Column 16, Line 37 (Claim 7, Line 8) between “the” and “nozzles” insert --cooling--

Column 16, Line 46 (Claim 8, Line 8) between “the” and “nozzles” insert --cooling--

Column 16, Line 47 (Claim 8, Line 9) between “the” and “nozzles” insert --cooling--

Signed and Sealed this
Eighteenth Day of December, 2012

David J. Kappos

David J. Kappos
*Director of the United States Patent and Trademark Office*